US008683623B2

(12) United States Patent
Ciechanowski et al.

(10) Patent No.: US 8,683,623 B2
(45) Date of Patent: Apr. 1, 2014

(54) CUSHION SYSTEM FOR A WASHING/BATHING TUB

(75) Inventors: Dominique Ciechanowski, Sainte-Marguerite-de-Dorchester (CA); Miguel Castellote, Sainte-Marguerite-de-Dorchester (CA)

(73) Assignee: C.G. Air Systemes Inc., Quebec (CA)

( * ) Notice: Subject to any disclaimer, the term of this patent is extended or adjusted under 35 U.S.C. 154(b) by 0 days.

(21) Appl. No.: 13/606,999

(22) Filed: Sep. 7, 2012

(65) Prior Publication Data

US 2012/0324642 A1 Dec. 27, 2012

Related U.S. Application Data

(60) Continuation of application No. 13/042,759, filed on Mar. 8, 2011, now Pat. No. 8,276,221, which is a division of application No. 11/029,340, filed on Jan. 6, 2005, now Pat. No. 8,328,789.

(60) Provisional application No. 60/534,375, filed on Jan. 6, 2004.

(51) Int. Cl.
*A47K 3/022* (2006.01)

(52) U.S. Cl.
USPC ..... 4/575.1

(58) Field of Classification Search
USPC ..... 4/538, 577.1, 575.1, 571.1, 559
See application file for complete search history.

(56) References Cited

U.S. PATENT DOCUMENTS

| | | | |
|---|---|---|---|
| 2,474,036 | A | 6/1949 | Curley |
| 3,020,562 | A | 2/1962 | Reynolds |
| 3,382,507 | A | 5/1968 | Micheau |
| 3,419,832 | A | 12/1968 | Baermann |
| 4,090,265 | A | 5/1978 | Baus |
| 4,888,835 | A | 12/1989 | Baumann |
| 4,949,407 | A | 8/1990 | Singer et al. |
| 5,144,703 | A | 9/1992 | Maire |
| 5,368,268 | A | 11/1994 | Jodwischat |
| 5,548,854 | A | 8/1996 | Bloemer et al. |
| 5,617,591 | A | 4/1997 | Bloemer et al. |
| 5,735,000 | A | 4/1998 | Pfaeffle |
| 5,867,843 | A | 2/1999 | Robello et al. |
| 6,575,892 | B1 | 6/2003 | Lauter |
| 6,626,303 | B1 | 9/2003 | Moodie |
| 2004/0034914 | A1 | 2/2004 | Gross |

*Primary Examiner* — Lori Baker
(74) *Attorney, Agent, or Firm* — Andrew F. Young, Esq.; Lackenbach Siegel, LLP

(57) ABSTRACT

A method for providing a cushion and tub assembly includes obtaining a cushion with magnets within the cushion. The method also comprises obtaining a metallic member, the metallic member magnetically attracting to the magnets in the cushion. The metallic member is permanently secured to a hidden surface of a tub at a location corresponding to a desired location of the cushion on the exposed surface of the tub. The tub and cushion are provided with a cushion being releasably connectable to the exposed surface of the tub at the desired location by attraction forces between the magnets and the metallic member through the tub wall.

8 Claims, 6 Drawing Sheets

CUSHION SYSTEM FOR A WASHING/BATHING TUB

CROSS-REFERENCE TO RELATED APPLICATION

The present application is a Continuation of the U.S. patent application Ser. No. 13/042,759, filed on Mar. 8, 2011 now U.S. Pat. No. 8,276,221 issued Oct. 2, 2012, which is a divisional of the U.S. patent application Ser. No. 11/029,340, filed on Jan. 6, 2005 now U.S. Pat. No. 8,328,789 issued Dec. 11, 2012, which claims priority on U.S. Provisional Patent Application No. 60/534,375, filed on Jan. 6, 2004, by the present Applicants.

BACKGROUND OF THE INVENTION

1. Field of the Invention

The present invention generally relates to washing/bathing tub accessories and, more particularly, to a cushion system to be used in a bathtub, a spa, a shower stall, a swimming pool, a whirlpool.

2. Background Art

Tubs are well known for their primary use, namely a washroom installation in which a user person washes, bathes. Tubs have however evolved to add pleasure and comfort to practicality, and are found in many forms, such as bathtubs, spas, whirlpools. For instance, tubs are now provided with air jet systems, whirlpool systems. There is an increasing variety of products, such as bathing oils, crèmes, lotions, that emphasize the therapeutic and health-beneficial aspects of bathing.

Tubs are generally sized and shaped so as to receive at least one user person in a sitting position, or partially lying position. Such tubs define a backrest surface, upon which a user person may rest his/her upper body and his/her head.

Accessories, such as cushions, have been developed, to accommodate the bather. One known cushion consists of a cushion, such as an inflatable pocket, a foam cushion or the like, equipped with suction cups, by which the cushion may be releasably secured to the backrest of the tub.

The efficiency of the suction cups in securing the cushion to the tub is questionable. The cushion may be partially immersed into the bathing water, and the buoyancy forces on the cushion may be sufficient to dislodge the suction cups. Also, the suction cups are sandwiched between the backrest and the cushion. This creates a gap between the backrest and the cushion, which may result in accrued pressure on the suction cups as a result of the deformation of the cushion when being pressured by the bather.

Another type of cushion used in tubs is provided with hooks, clips or the like, which are received in receptacles anchored to a surface of the tub. The receptacles are in some cases glued to the surface of the tub, in which case they do not make up a solid bond, as water may infiltrate and affect the effectiveness of the bonding agent. Alternatively, some receptacles are secured directly through the surface of the tub. This results in the presence of anchoring holes in the surface of the tub. The anchoring holes may result in water infiltration, and must be patched—if the receptacles are to be removed—leaving a mark in the surface of the tub.

SUMMARY OF INVENTION

It is an aim of the present invention to provide a novel cushion system for a washing/bathing tub.

It is a further aim of the present invention to provide a cushion system for a washing/bathing tub with an increased contact surface with a surface of the tub.

It is a still further aim of the present invention to provide a cushion system having a cushion member marrying a shape of a surface of a washing/bathing tub.

It is a still further aim of the present invention to provide a cushion system for a washing/bathing tub that is secured to a surface of the tub without altering a surface thereof.

Therefore, in accordance with the present invention, there is provided a method for providing a cushion and tub assembly, comprising: obtaining a cushion with at least one magnet within the cushion; obtaining at least one metallic member, the at least one metallic member magnetically attracting to the at least one magnet in the cushion; permanently securing the at least one metallic member to a hidden surface of a tub at a location corresponding to a desired location of the cushion on the exposed surface of the tub; and providing the tub and cushion with the cushion being releasably connectable to the exposed surface of the tub at the desired location by attraction forces between the at least one magnet and the at least one metallic member through the tub wall.

BRIEF DESCRIPTION OF THE DRAWINGS

Having thus generally described the nature of the invention, reference will now be made to the accompanying drawings, showing by way of illustration a preferred embodiment thereof and in which.

DESCRIPTION OF THE PREFERRED EMBODIMENTS

Figure 1:
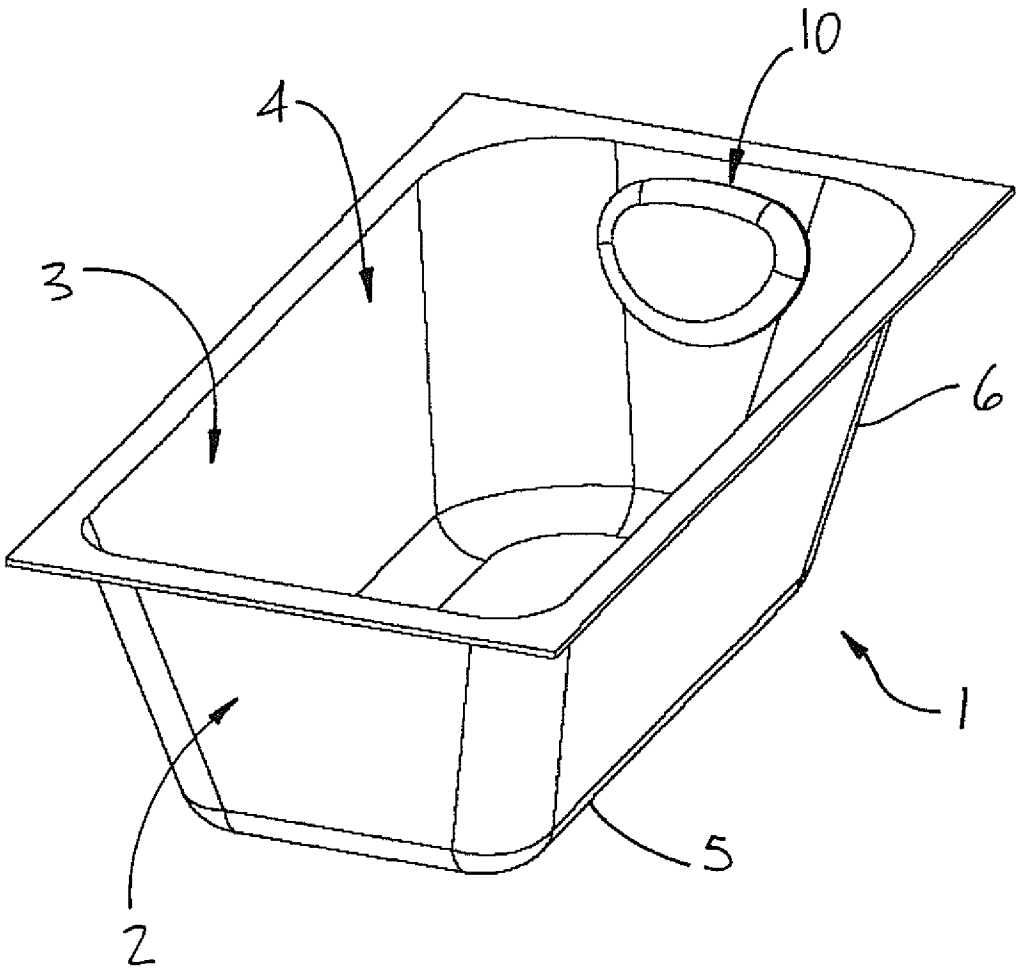
FIG. 1 is a perspective view of a cushion system for a washing/bathing tub constructed in accordance with a preferred embodiment of the present invention, as positioned within a bathtub.

Referring to the drawings and, more particularly, to FIG. 1, a cushion system for a washing/bathing tub in accordance with the present invention is generally shown at 10, in a bathtub 1.

The bathtub 1 has a hidden surface 2, and an exposed surface 3 which defines a water-receiving cavity 4, in which water is accumulated for a bath. The water-receiving cavity 4 of the bathtub 1 has a bottom wall 5 and a lateral wall 6, upon which the cushion system 10 is positioned. The bathtub 1 is of typical construction, and is made of materials such as enameled steel, stainless steel, cast iron, acrylonitrile-butadiene-styrene (ABS), acrylic, glass fiber or any other known material used to manufacture bathtubs.

Figure 4:
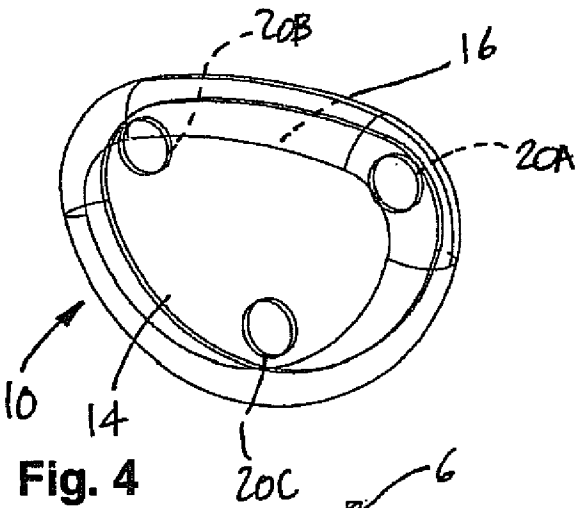
FIG. 4 is a perspective view of the cushion system of the present invention.
Figure 2:
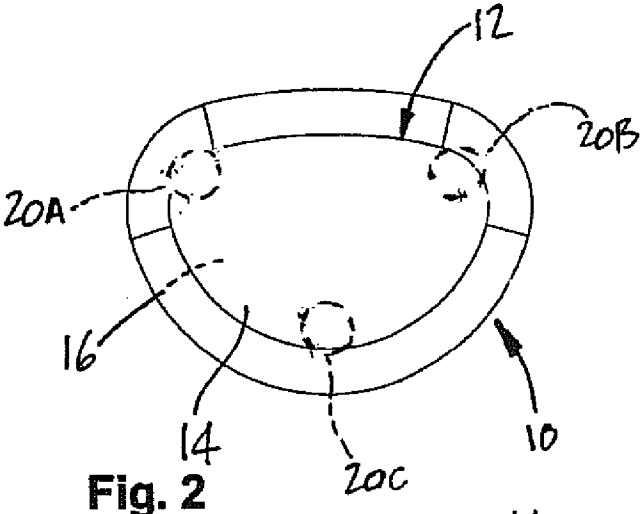
FIG. 2 is a front elevation view of the cushion system of the present invention.
Figure 3:
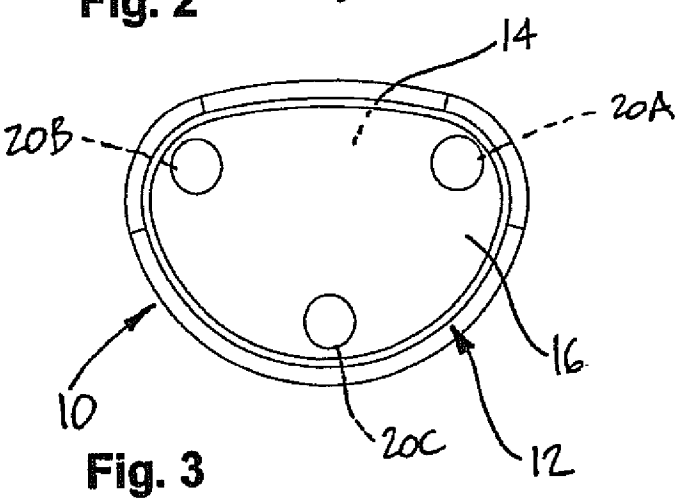
FIG. 3 is a rear elevation view of the cushion system of the present invention.

Referring concurrently to FIGS. 2-4, the cushion system 10 is shown having a cushion member 12. The cushion system 10 is to be used for instance as a headrest for a bather, or to support the limbs, back, torso, etc. . . . . The cushion member 12 has an arcuate contour, with a first surface 14 and a second surface 16. The first surface 14 is the abutment surface that is exposed when the cushion system 10 is mounted to a surface of the bathtub 1 (as shown in FIG. 1). It is the surface of the cushion member 12 upon which a bather leans/lies when using the cushion system 10. The second surface 16 is the surface that is opposed to the surface of the bathtub 1 (FIG. 1) upon which the cushion system 10 is mounted.

The cushion system 10 of the present invention makes use of magnetic forces to be secured to the exposed surface 3 of the bathtub 1. The cushion system 10 has a magnetic member connected to the cushion member 12. More specifically, in the embodiment of the present invention shown in FIGS. 2, 3 and 4, the cushion system 10 has magnets 20A, 20B and 20C. The magnets 20A, 20B and 200 are within the cushion member 12 and are disposed in a triangular pattern. As will be described hereinafter, the magnets of the cushion system 10 can be disposed in any suitable pattern. The amount of magnets may vary from one to more.

Figure 5:
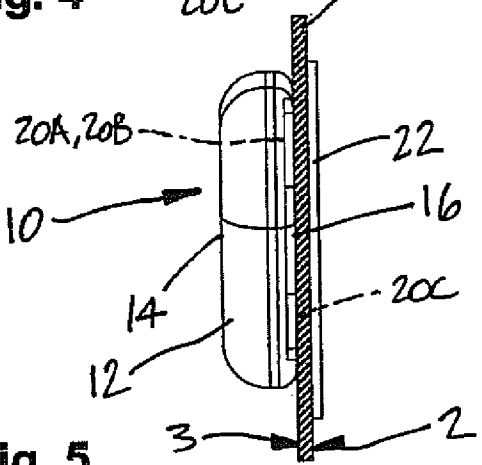
FIG. 5 is a side elevation view, partly sectioned, view of the cushion system as mounted to a wall of a bathtub.

In order for the cushion member 12 to be magnetically retained to a wall of the bathtub 1 (FIG. 1) by the magnets 20A, 20B and 20C, an opposite magnetic member must be present. Referring to FIG. 5, the cushion system 10 of the present invention is shown mounted to the exposed surface 3 of the lateral wall 6 of the bathtub 1. A metallic plate 22 is secured to the hidden surface 2 of the lateral wall 6 of the bathtub 1. The attraction between the magnets 20A, 20B and 20C and the metallic plate 22 is of sufficient magnitude to keep the cushion member 12 in position against the exposed surface 3 of the lateral wall 6. The metallic plate 22 is secured to the hidden surface 2 of the lateral wall 6 of the bathtub 6 by being screwed, glued, magnetized, by way of other mechanical fasteners or the like. The metallic plate 22 is on the hidden surface 2 of the bathtub 1, such that it will not be visible. Alternatively, the metallic plate 22 can be laminated into the material of the tub wall.

It is noted that the cushion member 12 illustrated in FIG. 5 marries the shape of the exposed surface 3 of the lateral wall 6 of the bathtub 1. This contact surface between the cushion member 12 and the surface of the bathtub will reduce the possibility of the cushion member 12 being unexpectedly dislodged, as will be described hereinafter.

Figure 6:
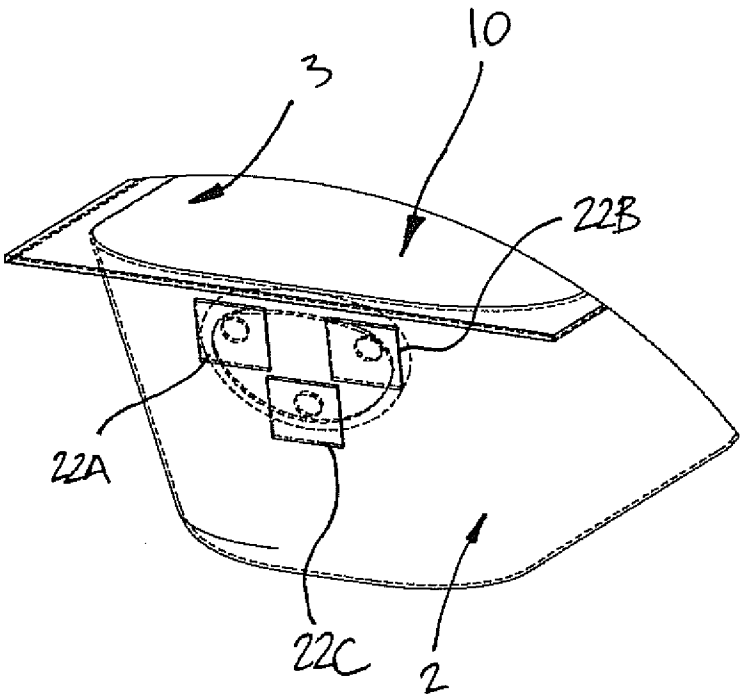
FIG. 6 is a fragmented perspective view of a metallic plate as mounted to a hidden surface of a bathtub with the cushion system of the present invention.

Referring to FIG. 6, metallic plates 22A, 22B and 22C are provided as an alternative to the single metallic plate 22 of FIG. 5. As an example, such an embodiment is well suited for bathtubs in which the lateral wall 6 has a non-negligible curvature, in which case a flat one of the metallic plate 22 would not marry the shape of lateral wall 6.

In the above instances, in which opposite magnets are on opposite sides of the lateral wall of the bathtub, the magnets can be of different sizes according to the thickness of the bathtub wall, so as to provide sufficient attraction forces for the cushion member 12 to remain in place.

Figure 7:
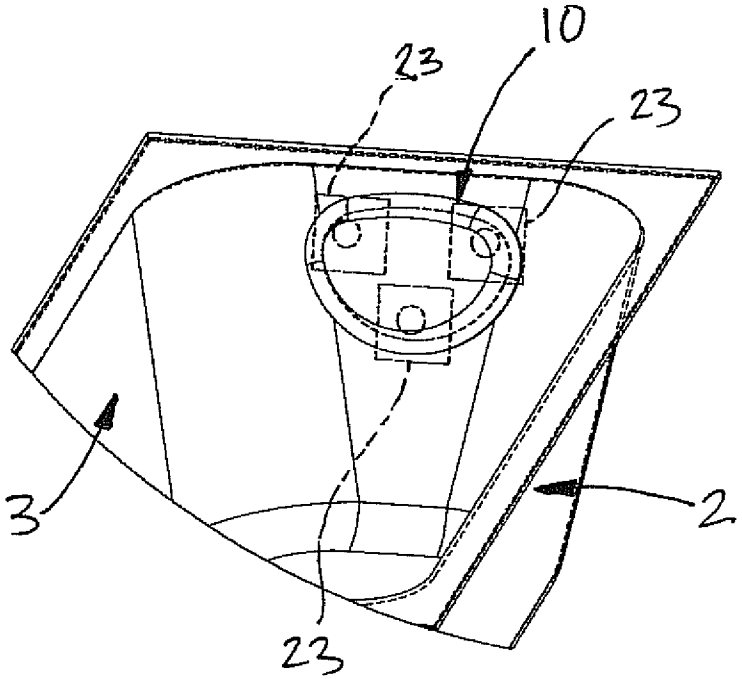
FIG. 7 is a fragmented perspective view of the cushion system of the present invention having a magnetic coating on a surface of the bathtub for being secured thereto.

Referring to FIG. 7, the lateral wall 6 of the bathtub 1 has been magnetized with a coating to have the required opposite magnetic member, as shown at 23.

In some cases, the bathtub 1 is made of material that has magnetic attraction properties (e.g., enameled steel, some stainless steel types). Accordingly, in such a case, no metallic plate (e.g., metallic plate 22 of FIG. 5, metallic plates 22A, 22B, 22C of FIGS. 6 and 7) are required to keep the cushion member 12 in position against the lateral wall 6 of the bathtub 1, as the lateral wall 6 acts as the opposite magnetic member.

Although the magnets 20A, 20B and 20C are illustrated as being concealed in the cushion member 12, it is contemplated to have them partially within the cushion member 12, or even on the second surface 16 of the cushion member 12. For instance, the magnets 20A, 20B and 20C may be glued to a surface of the cushion member 12.

It is preferred however to have the magnets 20A, 20B and 20C positioned within the cushion 12, in which case the contact surface between the bathtub 1 (FIG. 1) and the second surface 16 of the cushion member 12 is maximized. In doing so, the pressure sustained by the cushion system 10 when a bather lies/leans/abuts on the cushion member 12 will be spread onto the lateral wall 6 of the bathtub 1 through the contact surface therebetween. Otherwise, in instances where the cushion member 12 is spaced from the lateral wall 6 (such as with suction cups as described in the prior art), the cushion member 12 would deform to come in contact with the lateral wall 6 upon being leaned/lied upon, possibly resulting in lateral forces on the magnets/suction cups, which ultimately could dislodge the cushion member 12.

The cushion member 12 of the cushion system 10 may hence be of various shapes and colors, so as to marry the shape of the lateral wall of the bathtub. It is also contemplated to have the cushion system 10 positioned on the bottom wall 5 of the bathtub 1 (FIG. 1), for a bather to have an abutment for his limbs.

The use of magnetic forces results in the cushion member 12 being potentially removable from the bathtub, according to the preference of a bather. This feature facilitates the maintenance of the cushion member 12.

In some cases, the cushion 12 may be at least partially submerged in the water of the bath. The magnets of the cushion system 10 must in such a case produce a magnetic force of sufficient magnitude so as to overcome buoyancy forces between the cushion member 12 and the water of the bath that would otherwise dislodge the cushion member 12.

Although the cushion system 10 is illustrated as being anchored to a surface of the bathtub 1, it is contemplated to use the cushion system 10 in other types of tubs and washing/bathing enclosures, such as spas, whirlpools, swimming pools, shower stalls.

Although the embodiments illustrated in FIGS. 2 to 7 are provided with three magnets, namely magnets 20A, 20B and 20C, it is contemplated to provide the cushion system 10 of the present invention with a single magnet (e.g., of greater size), or any other suitable amount (e.g., 2, 4, etc. . . . ). It is pointed out that the magnets will not damage the exposed surface of the bathtub.

Figure 8:
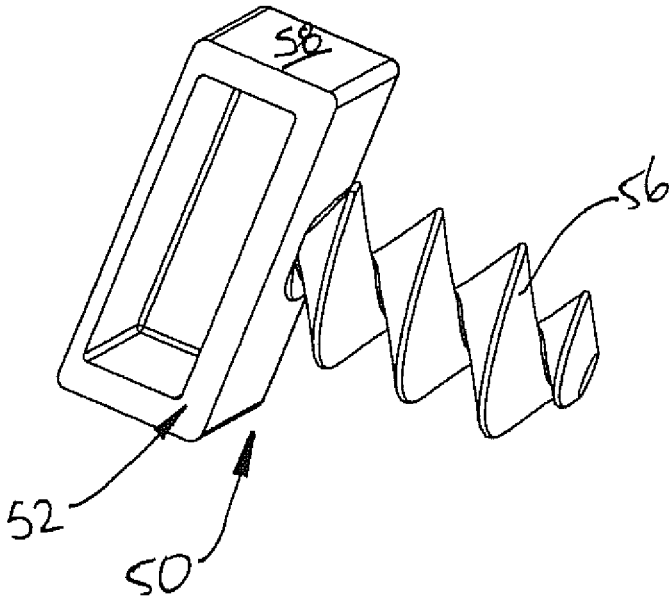
FIG. 8 is a perspective view of a connector portion of a magnet member in accordance with an embodiment of the present invention.
Figure 9:
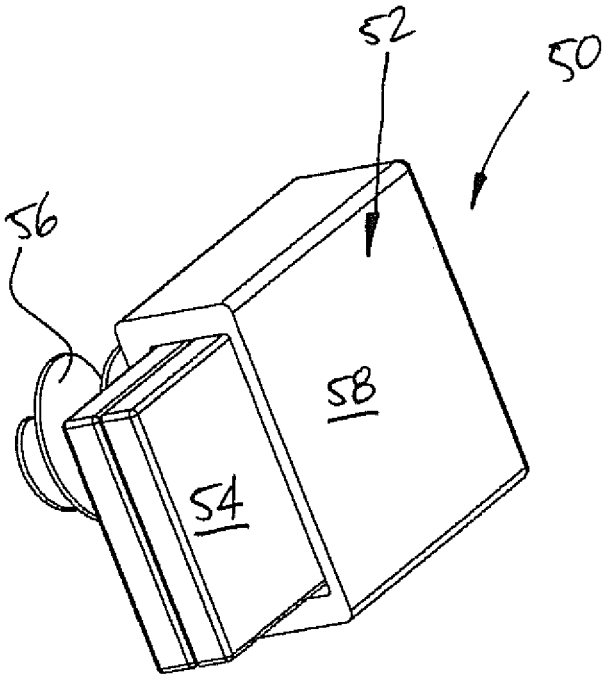
FIG. 9 is a perspective view of the connector portion having a magnet partially received therein to form the magnet member.

Referring concurrently to FIGS. 8 and 9, a magnet member 50 of the cushion system 10 is shown. The magnet member 50 has a connector portion 52 and a magnet 54 (FIG. 9). The connector portion 52 is provided to connect the magnet 54 to the cushion member 12.

Figure 10:
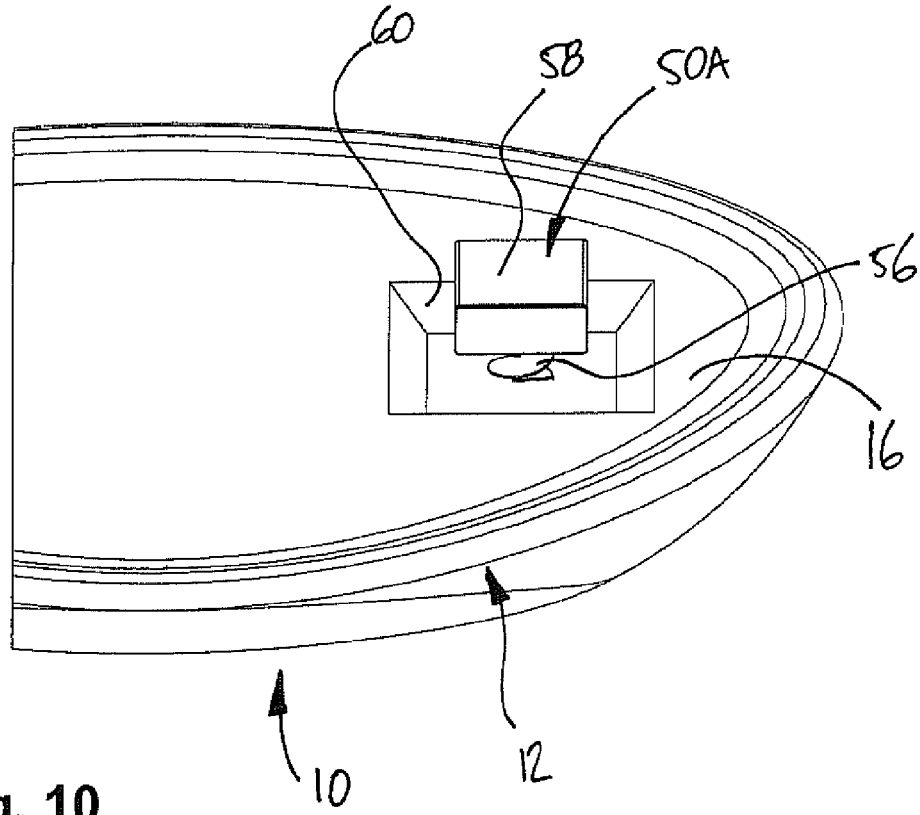
FIG. 10 is an enlarged perspective view of the magnet member as partially received in a cushion member of the cushion system.

The connector portion 52 has a threaded connector 56 for being screwingly engaged in the cushion member 12, as is generally shown in FIG. 10. An adhesive is typically used on the surface of the threaded connector 56 to secure the connector portion 52 to the cushion member 12. A receptacle 58 is provided at a free end of the threaded connector 56 so as to accommodate the magnet 54, as is well shown in FIG. 9. It is pointed out that the magnet 54 is partially received in the receptacle 58 in FIG. 10.

Figure 11:
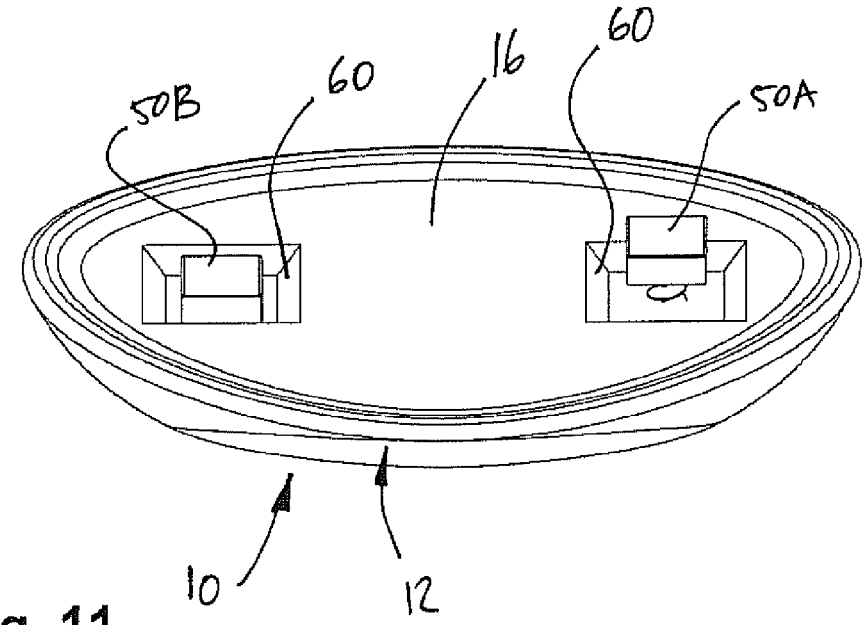
FIG. 11 is a perspective view of the cushion system with one of the magnet members partially secured to the cushion member.
Figure 12:
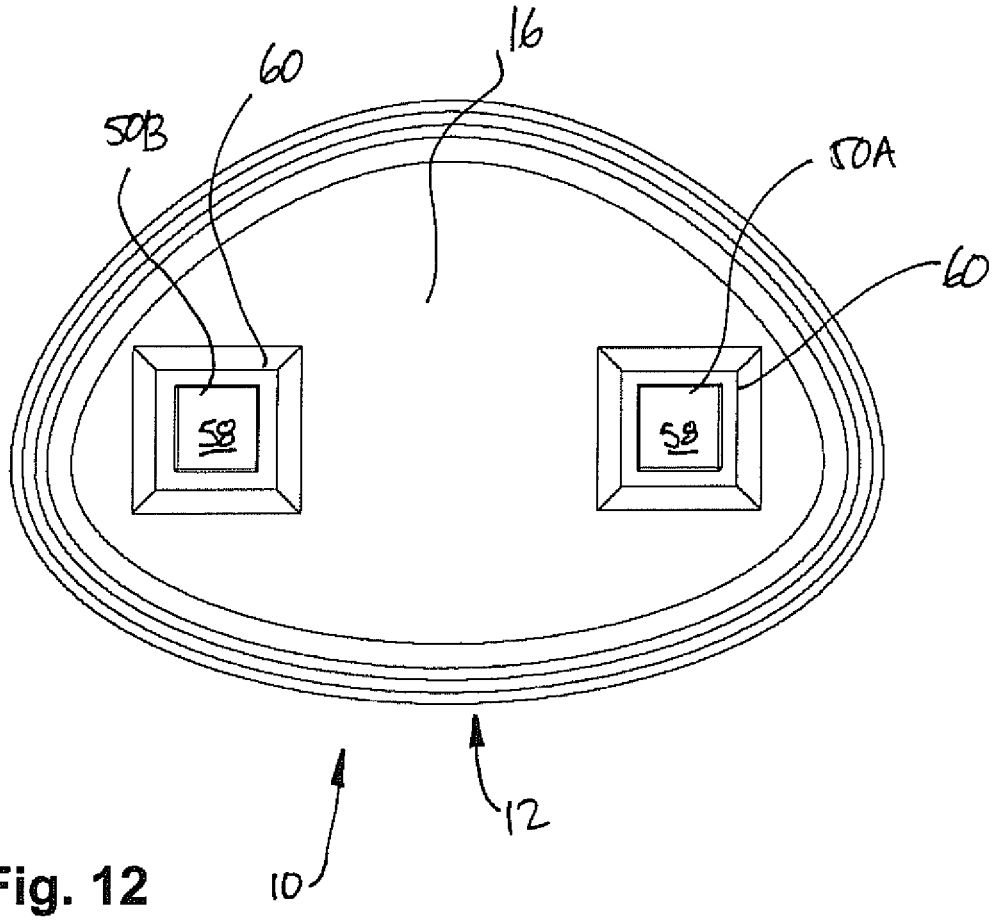
FIG. 12 is a rear view of the cushion system with the magnet members in use positions.

Referring concurrently to FIGS. 10 and 11, the cushion member 12 is shown having depressions 60 in its second surface 16. Accordingly, when the magnet members 50 are secured to their use position, as is shown for magnet member 50B in FIG. 11, the magnet members 50 are accommodated within the respective depressions 60. For instance, in FIG. 12, both magnet members 50A and 50B are in their use position. This feature ensures that the contact surface between the tub wall and the cushion system 10 is maximized. A cap is then be used to conceal the magnet 54 within the receptacle 60.

The cushion member 12 is made any of a plurality of materials, from which the cushion member 12 will benefit from the characteristics. For instance, the cushion member may be resilient as a user person will lie/abut thereagainst when taking a bath. The cushion member 12 may have an impermeable coating, or impermeable properties, so as not to absorb water. The cushion member 12 may be inflatable, to facilitate its storage and to offer various levels of cushioning.

It is within the ambit of the present invention to cover any obvious modifications of the embodiments described herein, provided such modifications fall within the scope of the appended claims.

We claim:

1. An assembly of a tub and cushion system for a washing/bathing tub, comprising:

a tub comprising a wall with an exposed surface defining a water-receiving cavity, and with a hidden surface;

a cushion member having an abutment surface adapted to offer support to a user person in the tub;

at least two connection members connected to the cushion, the connection members being within the cushion member with an exposed portion of the at least two connection members being coplanar with a rear surface of the cushion member or concealed therein such that the rear surface of the cushion member is coplanar with the surface of the tub when mounted thereto; and at least two opposite connection members secured to the hidden surface of the wall of the tub in a predetermined location of the tub in a spaced-apart relation similar to the spaced-apart of the two connection members of the cushion member, with each of the connection members magnetically attractingly connecting to a respective one of the opposite connection members through the wall of the tub to maintain the cushion member in position at the predetermined location against the surface of the tub for the abutment surface to be exposed to serve as support for the user person.

2. The assembly according to claim 1, wherein the at least two connection members are concealed in the cushion member.

3. The assembly according to claim 1, wherein a surface of the cushion member opposed to the surface of the tub has a shape marrying the surface of the tub.

4. A method for providing a cushion and tub assembly, comprising:

obtaining a tub with a cavity adapted to receive bathing water, the cavity defined by a non-metallic wall having an exposed surface in the cavity and a hidden surface;

obtaining a cushion with at least one connection member within the cushion;

obtaining at least one opposite connection member separate from the tub, the at least one opposite connection member magnetically attracting to the at least one connection member in the cushion;

permanently securing the at least one connection member to the hidden surface of a tub at a location corresponding to a desired location of the cushion on the exposed surface of the tub; and providing the tub and cushion with the cushion being releasably connectable to the exposed surface of the tub at the desired location by magnetic attraction forces between the at least one connection and the at least one opposite connection member on opposite sides of the tub wall.

5. The method according to claim 4, wherein obtaining a cushion comprises obtaining the cushion with at least two of the connection member, and wherein obtaining an opposite connection member comprises obtaining an equal number of opposite connection members and of the connection members.

6. The method according to claim 4, wherein permanently securing the at least one opposite connection member comprises gluing the opposite connection member to the hidden surface of the tub.

7. The method according to claim 4, wherein permanently securing the at least one opposite connection member comprises permanently securing the at least one opposite connection member in the desired location corresponding to the headrest area of the tub.

8. The method according to claim 4, wherein obtaining the cushion comprises obtaining the cushion with three of the magnet, the magnets being arranged in a triangular pattern.

* * * * *